United States Patent [19]

Carnahan et al.

[11] Patent Number: 5,060,325

[45] Date of Patent: Oct. 29, 1991

[54] INTEGRATED MATTRESS AND COMMODE WITH INTEGRATED BATHING SECTION

[76] Inventors: Monte Carnahan; Gayle A. Carnahan, both of 100 W. Cedar, Wilburton, Okla. 74578

[21] Appl. No.: 628,576

[22] Filed: Dec. 17, 1990

Related U.S. Application Data

[63] Continuation-in-part of Ser. No. 468,853, Jan. 23, 1990, which is a continuation-in-part of Ser. No. 439,849, Nov. 20, 1989, Pat. 4,944,058.

[51] Int. Cl.[5] ..... A61G 7/02; A61G 9/02; A61G 7/015

[52] U.S. Cl. ..... 5/90; 5/60; 4/547; 4/585

[58] Field of Search ..... 5/90, 60, 463, 66–69; 4/546, 547, 585

[56] References Cited

U.S. PATENT DOCUMENTS

| | | | |
|---|---|---|---|
| 1,762,944 | 6/1930 | Allison | 5/90 |
| 2,471,302 | 5/1949 | Boward | 4/547 |
| 2,500,739 | 3/1950 | Brem | 5/90 |
| 2,500,743 | 3/1950 | Brem et al. | 5/90 |
| 3,050,741 | 8/1962 | Coleman | 5/90 |
| 3,058,122 | 10/1962 | McDaniel et al. | 4/547 |
| 3,965,501 | 6/1976 | Bucher | 4/547 |
| 4,282,613 | 8/1981 | Violante | 5/90 |

*Primary Examiner*—Alexander Grosz

*Attorney, Agent, or Firm*—Ross, Howison, Clapp & Korn

[57] ABSTRACT

A bed with an integrated commode and inflatable bathing section includes a mattress (70) and a secondary support surface. The secondary surface is supported by a frame (90) and legs (92) and (94). Two padded sections (96) and (98) are disposed on the upper surface thereof. The end of the support section is comprised of a horizontal bar (100) and leg (102). A pad (106) is disposed on the upper surface thereof. The horizontal bar (100) can be lowered to a foot rest position or disposed in the same plane as the bar (90) to provide a resting position. A commode (18) is disposed under the center padded section (98) which has a hole (112) disposed therein. A splash guard (110) is disposed thereon. An inflatable bathing section (122) is provided for being disposed over the padded sections (96), (98) and (106), or in place thereof. The bathing section (122) has a vinyl surface (124) with a peripheral tube (126) disposed therearound. The tube (126) is inflatable with a pump (130). A drain (134) is disposed in the center portion thereof to allow bath water to drain into the commode (18).

4 Claims, 9 Drawing Sheets

FIG. 2
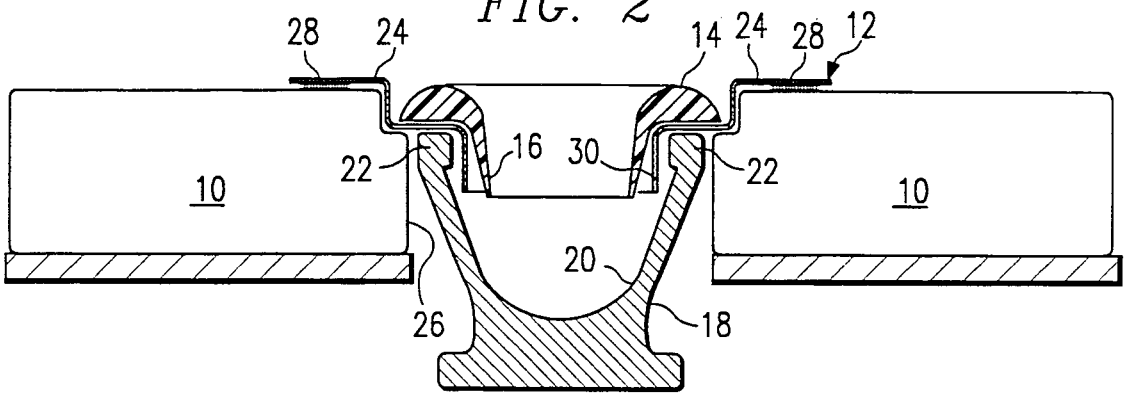
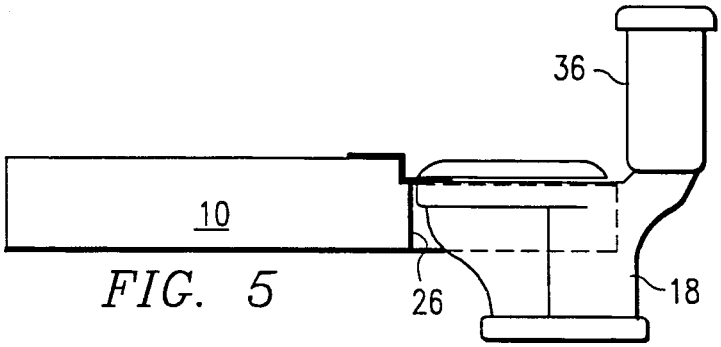
FIG. 5
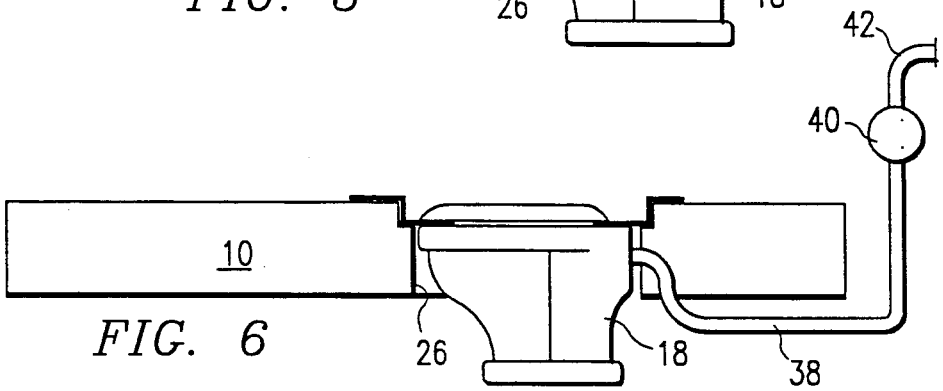
FIG. 6
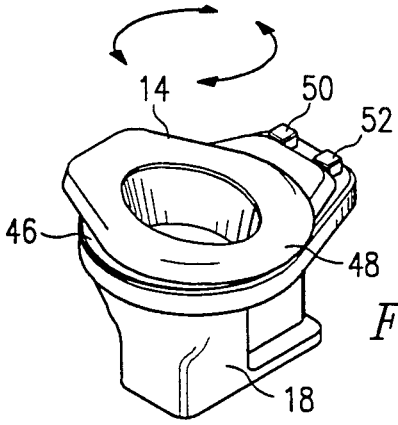
FIG. 7

INTEGRATED MATTRESS AND COMMODE WITH INTEGRATED BATHING SECTION

CROSS REFERENCE TO RELATED APPLICATIONS

This application is a continuation in part of U.S. patent application Ser. No. 468,853, filed Jan. 23, 1990 and entitled "Integrated Mattress and Commode With Segmented Mattress/Commode Section", which is a continuation in part of U.S. application Ser. No. 439,849, filed 11/20/89, now U.S. Pat. No. 4,944,058.

TECHNICAL FIELD OF THE INVENTION

The present invention pertains in general to a combination of a mattress, a bed frame, a commode insert and an inflatable bath insert.

BACKGROUND OF THE INVENTION

Traditional devices such as bedpans are often used for patients or elderly individuals in nursing homes and elderly or other individuals confined to bed at home or individuals having balance problems thus subject to falling and necessitating the need for someone to be with them. However, these devices usually require the dependency of the patient or elderly individual on the nursing staff of an institution, or on care providers at home. Other conventional devices known in the art require that the patients be displaced relative to their beds, or leave their beds, in order to enable them to use the toilet in a seated, normal upright position.

Devices that have integrated a commode with the actual bed itself have been overly complicated. For example, in U.S. Pat. No. 3,959,833, issued to Burke et al., an insert is provided whereby a portion of the mattress is removed and a portable commode is inserted therefore. However, the individual is required to assist in positioning this commode in the bed. This type of system does not facilitate connection to plumbing sanitary waste of domestic water lines and still requires some other type of intervention by the nursing staff, or care provider.

SUMMARY OF THE INVENTION

The present invention disclosed and claimed herein comprises a mattress with an integrated commode and bathing section. A mattress and bed frame are provided that comprise a primary sleeping surface. A commode with a seat is provided for being disposed adjacent to the bed. A secondary support surface and associated support are disposed over the commode with a hole in the secondary support surface to receive the commode. The upper surface of the commode is proximate to the same plane as the surface of the secondary support surface. The secondary support surface is divided into a first support section and a secondary support section. The first support section is divided into a central portion and a head portion. A pad is provided over the head portion and a pad is provided over the central portion adjacent to the same side. The second portion is a foot rest portion that also has a pad disposed thereon. The foot rest portion is adjustable in a foot rest position, the foot rest position that is below the plane of the secondary support surface. A second position, a resting position, is provided for the foot rest portion that is parallel to the upper surface of the support section. The foot rest portion is adjustable between the two positions. An inflatable bathing section is provided that includes a vinyl base layer having a peripheral inflatable tube. The inflatable tube when inflated rises above the surface of the vinyl and contains water therein. A drain in the center thereof communicates with the commode.

BRIEF DESCRIPTION OF THE DRAWINGS

For a more complete understanding of the present invention and the advantages thereof, reference is now made to the following description taken in conjunction with the accompanying Drawings in which:

FIG. 2 illustrates a cross-sectional diagram of the commode and mattress;

FIG. 5 illustrates a cross-sectional side view of an embodiment utilizing a tank type commode;

FIG. 6 illustrates a side cut-away view of an embodiment utilizing a flush valve;

FIG. 7 illustrates a detail of the swivel operation of the commode seat for use with the tank-type and/or flush valve system in the supine position;

DETAILED DESCRIPTION OF THE INVENTION

Figure 1:
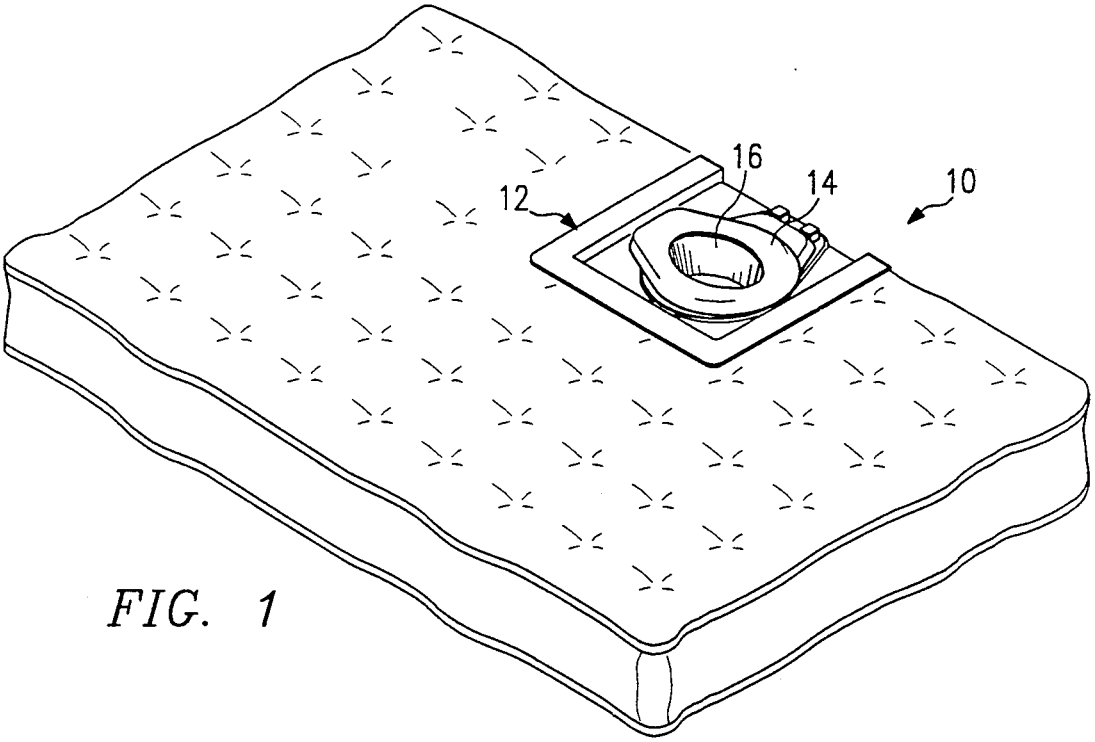
FIG. 1 illustrates a perspective view of the integrated commode and mattress.

Referring now to FIG. 1, there is illustrated a perspective view of the mattress 10 in which a commode is inserted. The commode is hidden by the mattress and is not shown in FIG. 1. A sanitary insert 12 is provided which is operable to be disposed over an opening (not shown) in the mattress 10. The sanitary insert has a flat portion that is operable to be disposed on the surface of the mattress 10 or moisture-proof mattress cover adjacent the periphery of the opening in the mattress 10. The sanitary insert 12 also has a vertical portion that is operable to be disposed downward into the opening to provide a seal and extend into the opening of the commode. A commode seat 14 is provided which is operable to be disposed over the sanitary insert, the commode seat 14 having a splash guard 16 extending downward from the interior rim thereof into the commode.

Referring now to FIG. 2, there is illustrated a cross-sectional diagram of the mattress 10 and a commode 18. The commode 18 has an interior 20 and an upper rim 22. The upper surface of the mattress 10 or moisture-proof mattress cover is approximately one inch higher than the upper surface of the commode seat 14. In this manner, the weight of an individual on the mattress 10 proximate to the commode seat 14 results in compression of the mattress 10 to approximately the level of the commode seat 14, thus enabling the individual to easily move from the mattress 10 to the commode seat 14.

The sanitary insert 12 has an upper flat surface 24 extending from an opening 26 in the mattress 10 away from the edge thereof. The flat surface 24 is attached to the mattress 10 or moisture-proof mattress cover by a hook and loop type attachment 28 around the peripheral edges of the flat surface 24. The sanitary insert 12 has a vertical portion 30 that extends downward into the commode and over the upper lip 22. The sanitary device 12 is a water repellent material such that any fluids and the such that fall on the upper surface of the sanitary device 12 will fall downward into the interior 20 of the commode 18 and will not go between the commode 18 and the mattress 10 through the opening 26. This provides an increased moisture barrier.

The commode seat 14 is operable to be disposed over the sanitary device 12 and in adjacent contact with the lip 22 such that it holds sanitary device 12 in secure contact with the upper lip 22 of the commode 18. The splash guard 16 is typically fabricated of a hard plastic material which can be cleaned and extends downward essentially the same distance as the vertical portion 30 of the sanitary insert 12. The sanitary insert 12 is, in the preferred embodiment, an acetate tricot laminated to a vinyl back. This is designed to be a disposable or washable material that can be removed and disposed of or washed whenever it becomes soiled. A new or clean insert can then be disposed over the opening between the seat 14 and the upper lip 22.

Figure 3:
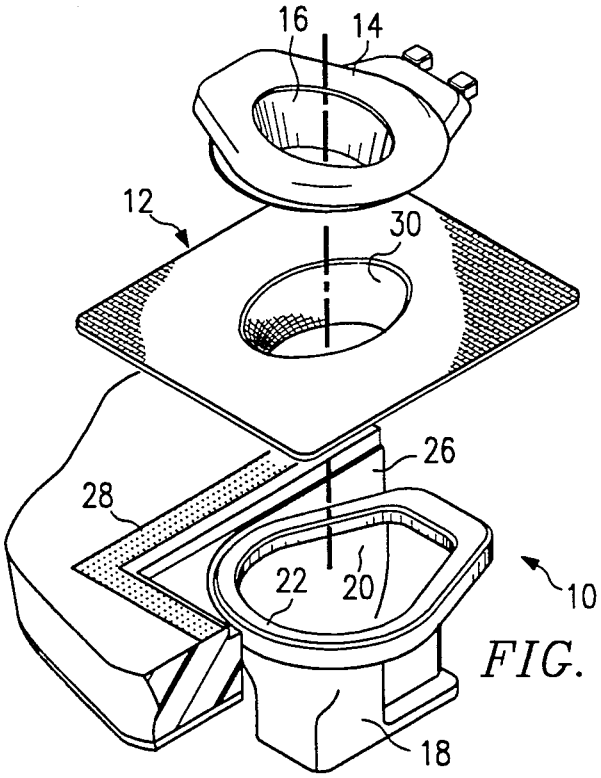
FIG. 3 illustrates a blow-up view of the sanitary insert, the commode seat and the commode, with a cut-away view of the mattress.

Referring now to FIG. 3, there is illustrated a blow-up of the commode seat 14, the sanitary insert 12 and the commode 18 with a cut-away of the bed 10. It can be seen that the hook and loop strips 28 are formed on the surface of the bed 10 or moisture-proof mattress cover and the sanitary insert 12 is first disposed down over the opening 26 and the interior 20 of the commode 18, this providing a waterproof seal over the lip 22 of the commode 18. The hook and loop strips 28 are then attached to pr the movement of the sanitary insert 12 and then the commode seat 14 disposed through the opening in the sanitary insert 12 such that the splash guard 16 is disposed adjacent the portion 30 of the sanitary insert 12 and completely surrounded thereby. Similarly, the sanitary insert 12 can be removed by reversing this process.

Figure 4:
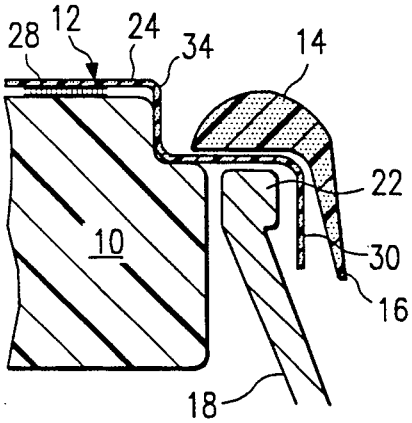
FIG. 4 illustrates a detail of the sanitary seal provided by the sanitary device and the commode seat.

Referring now to FIG. 4, there is illustrated a detailed view of the installation of the sanitary insert 12 illustrating in detail one of the upper lips 22 of the commode 18 and the seal formed by the sanitary insert 12 between the commode lid 14 and the upper lip 22. The sanitary insert 12 can either be formed from a single molded piece of material or, more preferably, it is formed from two portions, flat portion 24 and downwardly extended portion 30, sewn together at a point 34. As described above, this is a disposable or washable insert and may be changed or washed, respectively, only when needed. The splash guard 16 prevents excessive soiling of the downwardly extended portion 30, thus reducing the need for changing or washing on a frequent basis.

Referring now to FIG. 5, there is illustrated one embodiment of the installation of the commode 18 and the mattress 10. A tank-type commode can be utilized which has a supply tank 36 disposed on the back thereof. With this type of system, the commode must be disposed adjacent the edge of the bed such that a tank can protrude upward therefrom. Therefore, the opening 26 would be disposed at one edge of the mattress 10.

Referring now to FIG. 6, in an embodiment of the present invention, the commode 18 operates on a flush valve. Therefore, the commode 18 can be disposed in any location within the periphery of the mattress 10 and a water line 38 routed over to a flush valve 40 which goes to a water supply through a pipe 42. The flush valve 40 allows sufficient pressure to be routed to the commode 18 to provide the flushing action. However, the commode 18 should still be disposed adjacent the edge of the bed to allow adequate sleeping space capability, and to enable the patient to use toilet in a seated upright position. Additionally, the flush valve 40 must be located in an easily accessible location. Alternatively, the flush valve 40 could be replaced by a water closet (not shown) that would be disposed at a height sufficient to generate enough pressure for the flushing operation.

Referring now to FIG. 7, there is illustrated a swiveling mechanism for the commode seat 14. Typically, the commode 18 must be oriented to accommodate the water lines, the soil pipe, etc. However, commode seats are "polarized" to provide a proper anatomical accommodation. Most commode seats are configured for an upright sitting position whereas the present invention is utilized in a supine position to accommodate a more comfortable position for those individuals unable to sit in an upright position. The commode seat 14 preferably is foam padded. As such, the commode seat may not be oriented in the right direction and, therefore, the swiveling seat of FIG. 7 is provided. The seat 14 is comprised of a bottom portion 46 and an upper portion 48. The bottom portion 46 has two hinged brackets 50 and 52 which are normally found on a commode seat. These interface with the commode itself in a conventional manner. The upper portion 48 swivels about the bottom portion 46. In the preferred embodiment, this utilizes a slot-and-eye bolt with the eye-bolt being driven from the other side of the upper portion 48 and the slot being positioned in the lower portion 46. Alternatively, variously pre-drilled holes can be provided for the downwardly directed bolt (not shown), such that the seat can be positioned in a number of predetermined orientations. The primary object of the seat of FIG. 7 is to provide different orientations which can be provided by either a pivoting/locking mechanism or by pre-drilled holes.

Figure 8:
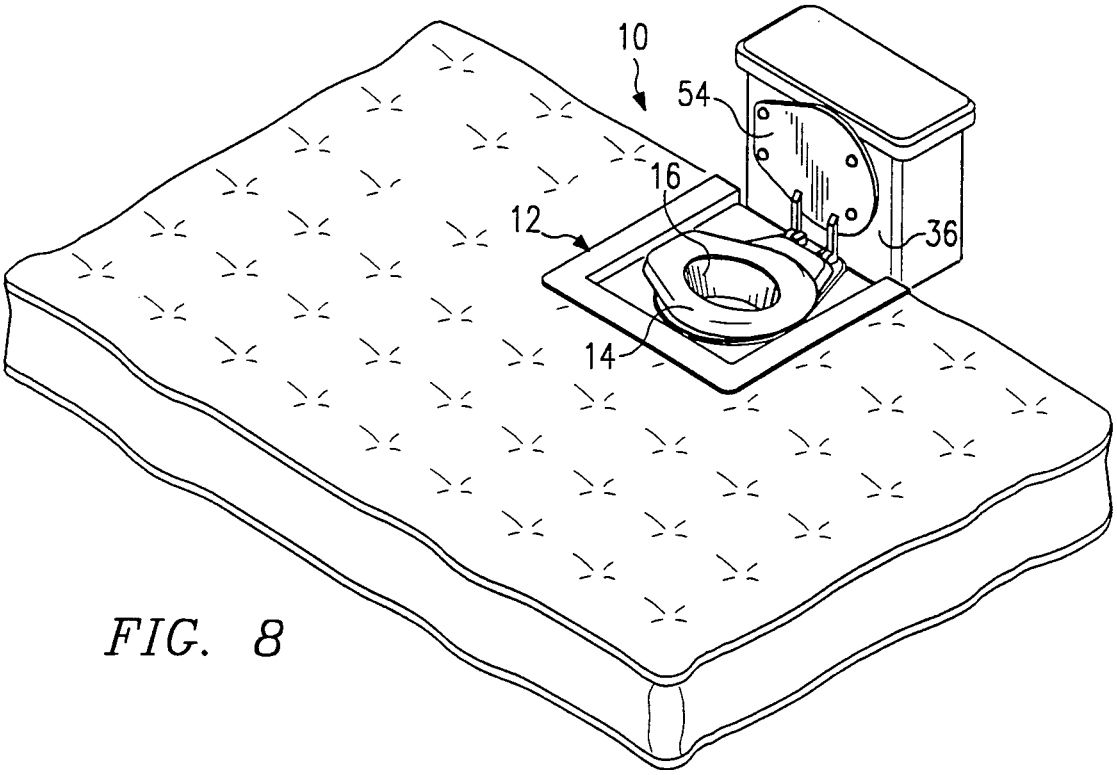
FIG. 8 illustrates an embodiment for utilization with a cover.

Referring now to FIG. 8, there is illustrated an embodiment of the closed seat of FIG. 1. In the embodiment of FIG. 8, a cover 54 is provided which is operable to be raised and lowered relative to the tank 36 and cover the seat 14. In this manner, the opening in the commode can be covered.

Figure 9:
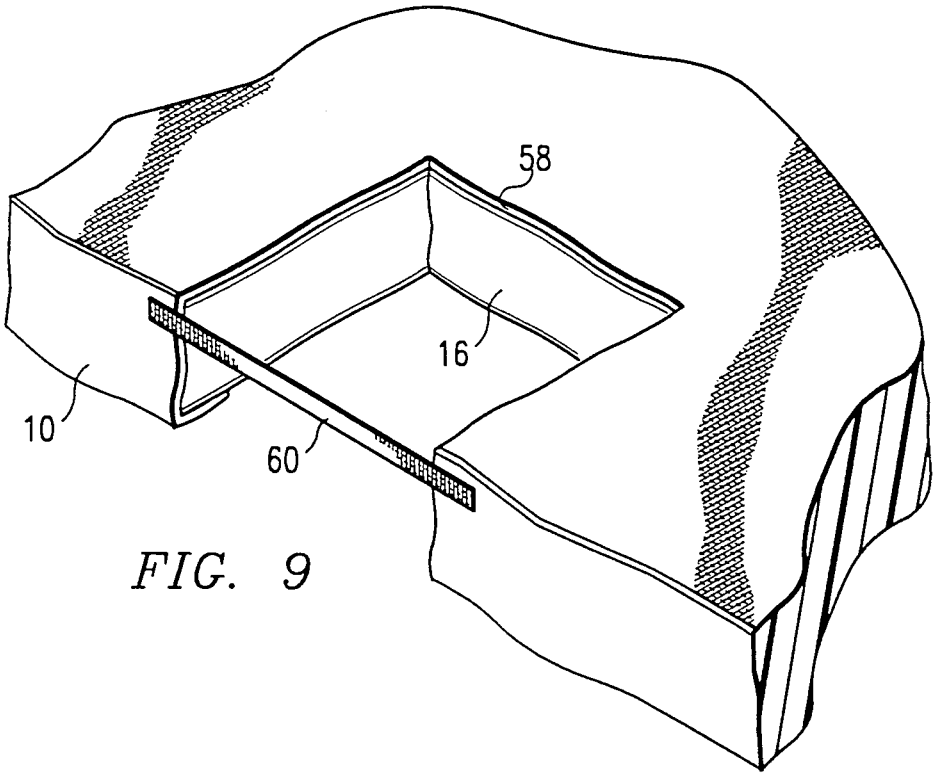
FIG. 9 illustrates the attachment of the mattress cover in the slot formed in the mattress.

Referring now to FIG. 9, there is illustrated a detail of the slot formed in the mattress 10. A mattress cover 58 is provided which is sized to allow the slot to be opened. The slot is formed on the edge of the mattress 10 and on the open end of the slot, there is provided a restraining strap 60, the restraining strap 60 attaches to the mattress cover on either side of the opening in the edge of the mattress 10. This allows the tank type or flush valve commode to be disposed therein and retain the original shape of the mattress cover 58.

Figure 10:
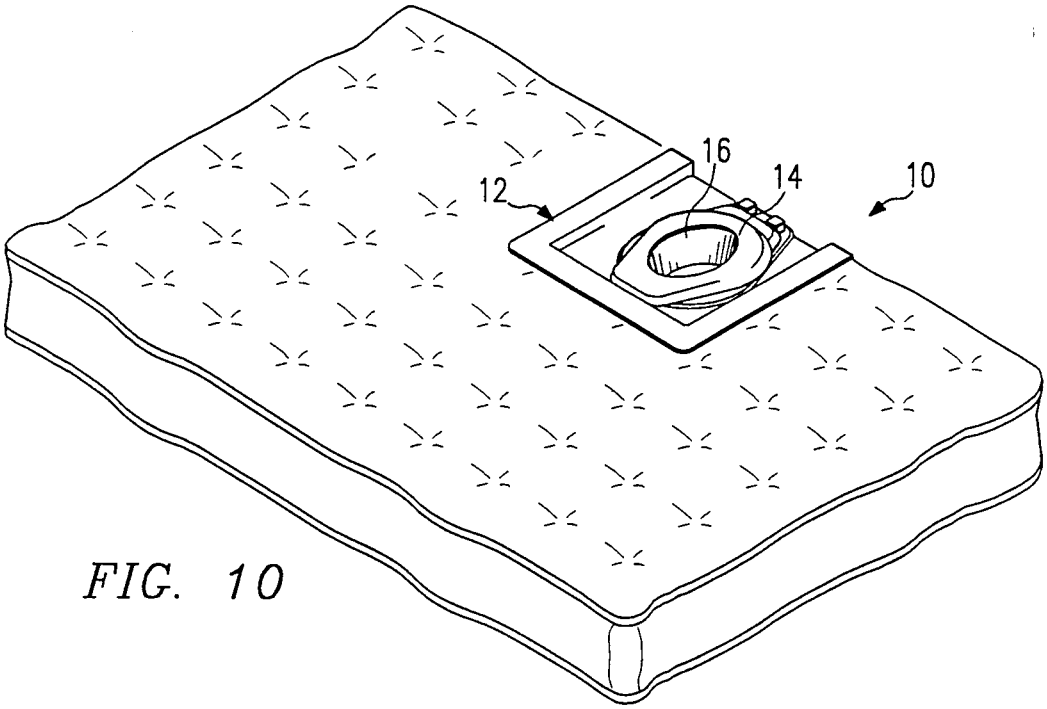
FIG. 10 illustrates an embodiment wherein the commode seat is disposed on the edge of the mattress and oriented such that it facilitates use in the seated normal upright position.

Referring now to FIG. 10, there is illustrated an alternate embodiment. The commode seat 14 is illustrated as being disposed at a 180° angle with respect to the normal orientation. This facilitates use with the legs draped over the side of the bed and in a seated upright position. The flush valve commode 18 of FIG. 6 would be preferred for this embodiment, which would be disposed adjacent the edge of the bed. However, the tank type commode can still be used effectively in the event water pressure is not adequate to use the flush valve commode.

Figure 11:
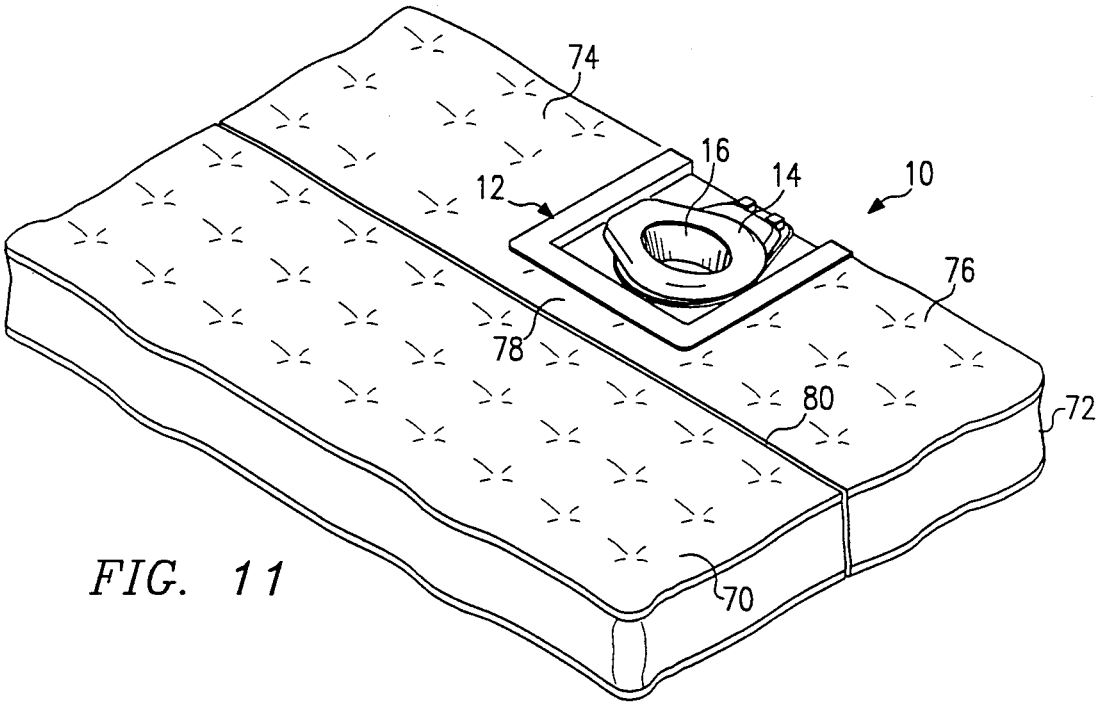
FIG. 11 illustrates an embodiment of the present invention in a perspective view.

Referring now to FIG. 11, there is illustrated a perspective view of an embodiment of the present invention. A mattress 70 is provided which is a conventional mattress. The commode 18 is disposed with the insert 12 in a separate and smaller mattress portion 72. Mattress portion 72 is comprised of a surface 74 and a surface 76 disposed on either side of the commode 18. The surfaces 74 and 76 are bridged together by portion 78 that is disposed in front of the commode 18. The combination of the surface 74 and surface 76 and the bridging portion 78 form an edge 80 that mates with one edge of the mattress 70. The surface 74 and the surface 76 and the upper surface of the bridging portion 78 are in the same plane with upper surface of the mattress 70. Therefore, when mattress 70 is abutted with the edge 80, an individual can easily move from the sleeping surface on mattress 70 to the upper surface of the commode 18. With the use of the mattress portion 72, a standard sleeping surface on mattress 70 can be utilized while the combination of mattress portion 72 and mattress 70 results in an integrated mattress and commode. Further, the surfaces 74 and 76 are made merely for support and not for the purpose of sleeping, whereas the upper surface of the mattress 70 provides the primary sleeping surface.

Figure 12:
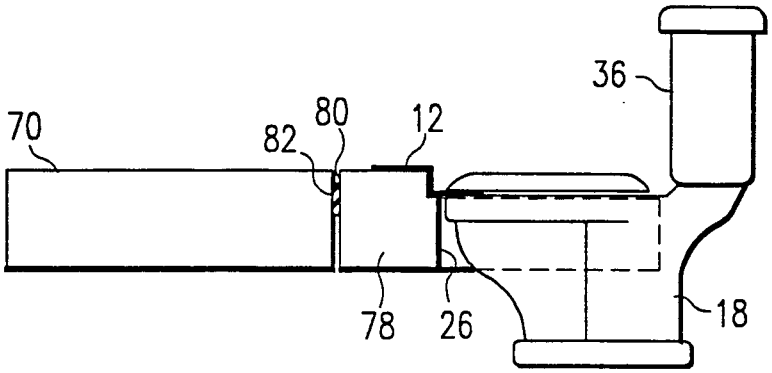
FIG. 12 illustrates a cross-sectional view of the embodiment of FIG. 11 illustrating the mating of the two portions.

Referring now to FIG. 12, there is illustrated a cross-sectional diagram of the embodiment of FIG. 11 taken through the commode 18 and illustrating the junction between the edge 80 of the bridging portion 78 and the abutting portion of mattress 70.

Figure 13:
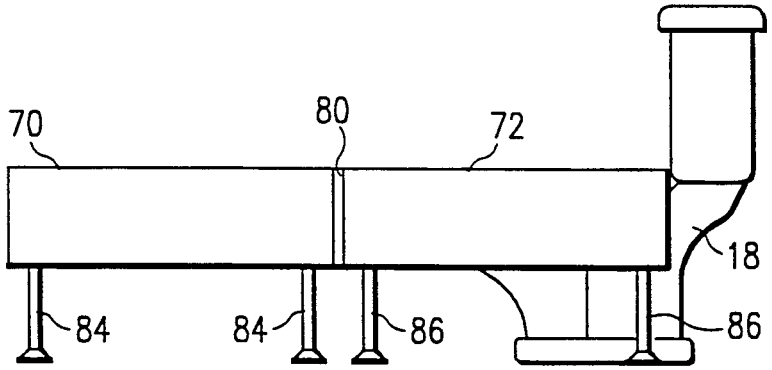
FIG. 13 illustrates a cross-sectional view of the mattress portion adjacent to the commode.

Referring now to FIG. 13, there is illustrated a side view of the mattress 70 and the mattress portion 72. The mattress 70 has supporting legs 84 associated therewith which defines the height of the upper surface of the mattress 70 over the floor. Since it is desirable that the upper surface of the mattress portion 72 be at the same height as the mattress 70, adjustable legs 86 are provided. The adjustable legs 86 are generally comprised of two portions, a secured portion on the bottom surface of the mattress portion 72 and a telescoping portion that extends outward therefrom and down to the floor. In this manner, the mattress portion 72 can be adjusted in height. A securing device 82 is provided that is disposed between the one of the legs 86 and the one of the legs 84 disposed proximate to the edge 80. Securing device 82 holds the mattress portion 72 and the mattress 70 together.

Figure 14:
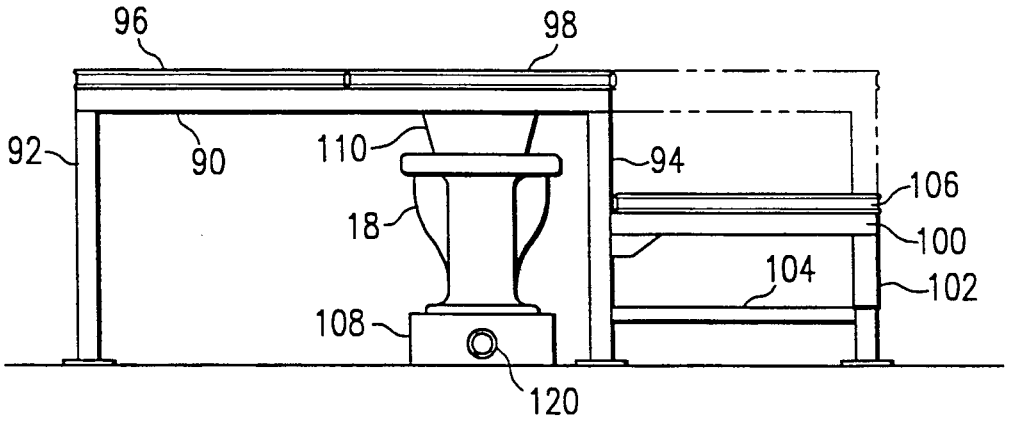
FIG. 14 illustrates a side view of the segmented commode section with the end section thereof lowered as a foot rest.

Referring now to FIG. 14, there is illustrated an alternate embodiment of the present invention described above with respect to FIGS. 11–13. The segmented section is comprised of two portions. The first portion includes a frame having a horizontal section 90 with legs 92 and 94. The horizontal section 90 is approximately four feet long and has two padded sections, a head padded section 96 and a center padded section 98. The second portion of the segmented section is comprised of an adjustable frame with a horizontal section 100 and a leg 102. A brace 104 is provided that extends between the leg 102 and the leg 94. The horizontal portion 106 is operable to attach at one end thereof to the leg 94. The adjustable portion is illustrated in the lower portion to operate as a foot rest. An end padded section 106 is provided on the upper surface of the horizontal bars 100. The upper resting position is illustrated in phantom lines.

The commode bowl 18 is disposed beneath the center padded section 98 on a platform 108 to allow the upper surface of the commode 18 to be closer to the lower surface of the padded section 98. A splash guard 110 is provided that is attached to the padded section 98.

Figure 15:
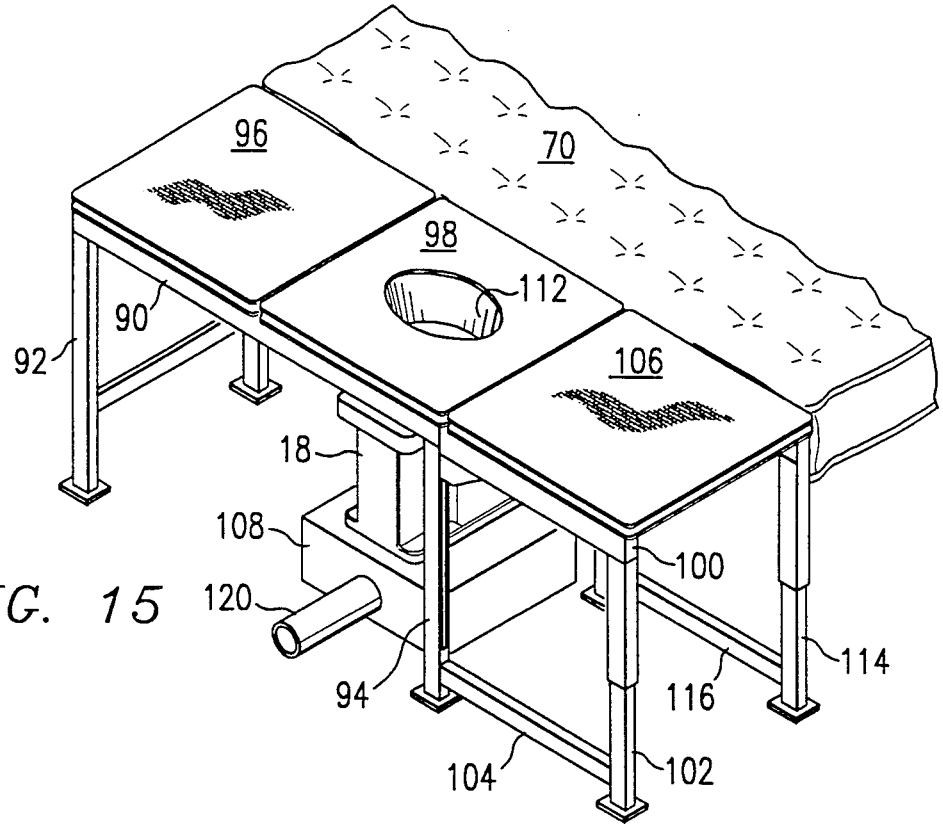
FIG. 15 illustrates a perspective view of the segmented commode section with the foot rest raised to provide a flat surface.

Referring now to FIG. 15, there is illustrated a perspective view of the section of FIG. 14 adjacent the mattress 70 and also illustrated in the raised or resting position. The center padded section 98 has a hole 112 disposed in the center thereof similar to that of the commode seat described hereinabove. The adjustable section has a second leg 114 similar to the leg 102 and also a brace 116 similar to brace 104. In the raised position, the padded section 96, the padded section 98 and the padded section 106 provide a platform to allow and individual to move themselves from the bed over to the commode portion in essentially the same plane. The commode 18 is typically mounted on a permanent fixture with a sewer line 120 being connected thereto. The sewer line 120 being connected to the conventional sewer system. It should be understood that the padded section and associated support could be automatically adjusting.

Figure 16:
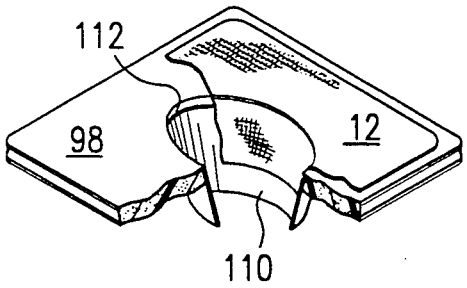
FIG. 16 illustrates a detailed cross-sectional view of the center section having the splash guard integrated therewith.

Referring now to FIG. 16, there is illustrated a detailed diagram of the center padded section 98. The center padded section 98 as described above has a hole 112 disposed therethrough. The splash guard 110 is integrally formed with the center padded section 98 about the lower edge of the hole 112. The sanitary insert 12 is operable to be disposed over the padded section 98. Center padded section 98 is fabricated from a vinyl material such that it can be cleaned.

Figure 17:
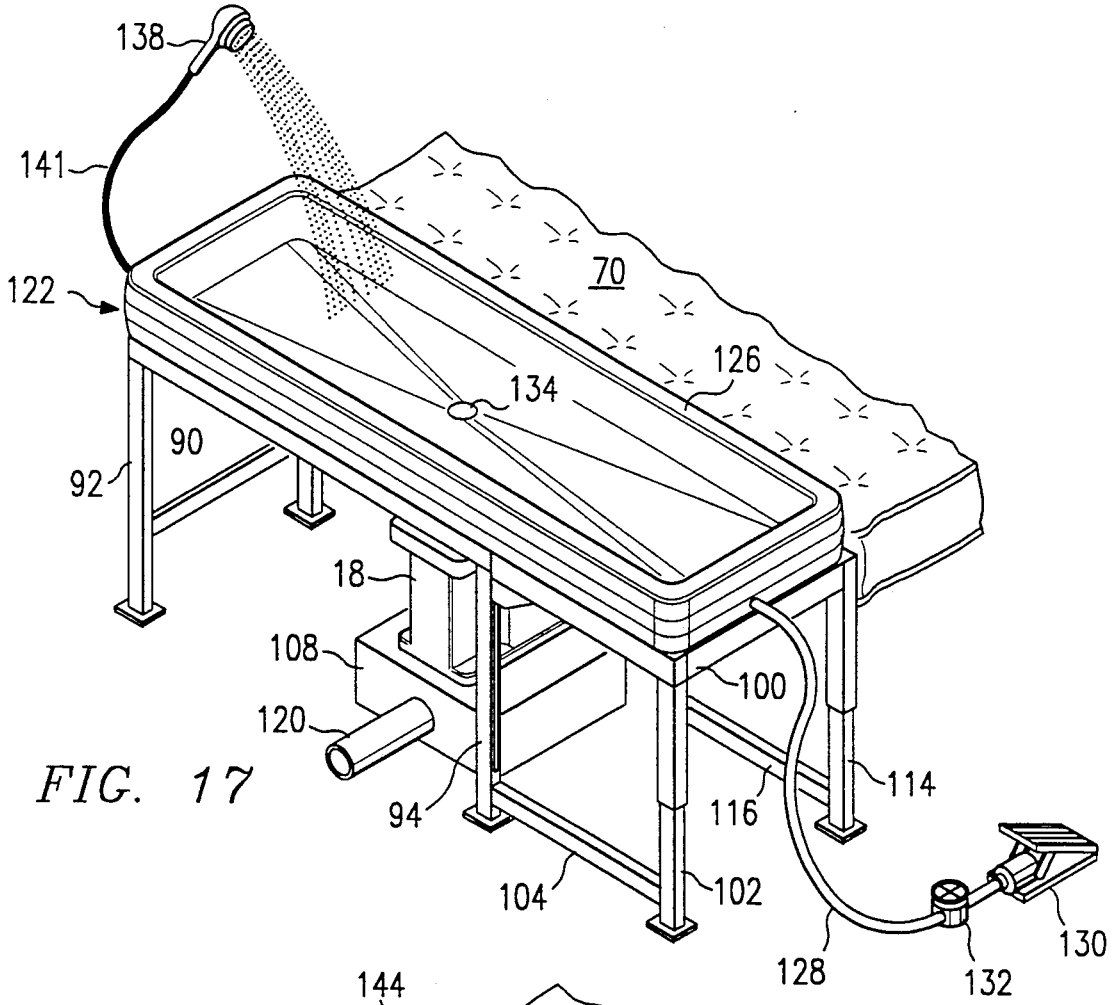
FIG. 17 illustrates a perspective view of the segmented commode section having an inflatable bath section.

Referring now to FIG. 17, there is illustrated an alternate embodiment of the present invention utilizing an inflatable bath section 122 which lays on top of the padded sections 96, 98 and 106. The bath section 122 is comprised of a vinyl base liner 124 and an inflatable tube 126 disposed about the periphery of the vinyl base section 124 and integral therewith. The tube 126 is connected through a hose 128 to a pump 130. A valve 132 is disposed in line with the hose 128. When the valve is open in one direction, it allows inflation of the tube 126.

A foot operated air pump 130 is operable to perform this inflating operation. The valve 132 is also operable in a second position to allow the air to escape from the tube 126 to allow it to deflate. A drain 134 is provided in the central portion of the base layer 124 such that it is disposed over the commode 18 to allow draining to be accomplished into the commode 18.

In operation, the patient disposed on the mattress can be moved into and over the base layer 124. When the patient is over the base layer 124, the tube 126 can be inflated. Thereafter, the patient can be washed by utilizing a showerhead 138 that is connected to a water supply through a water hose 141. The water will be contained in the interior space and be allowed to drain through the hole 134.

Although not illustrated, the legs 92, 94, 102 and 114 could be disposed on rollers with a collection container and a water supply associated therewith. In this manner, the drain hole 134 would not have to be connected to a permanent sewer line. Rather, the water could be collected in a waste container or by a hose to a remote waste container. Further, a water supply could be provided which could either be pressurized or hand operated to allow water to be applied to the patient. After the patient has been bathed, the water can be drained through the hole 134 and then the tube 126 deflated with the valve 132 and the patient moved back to the mattress 70.

Figure 18:
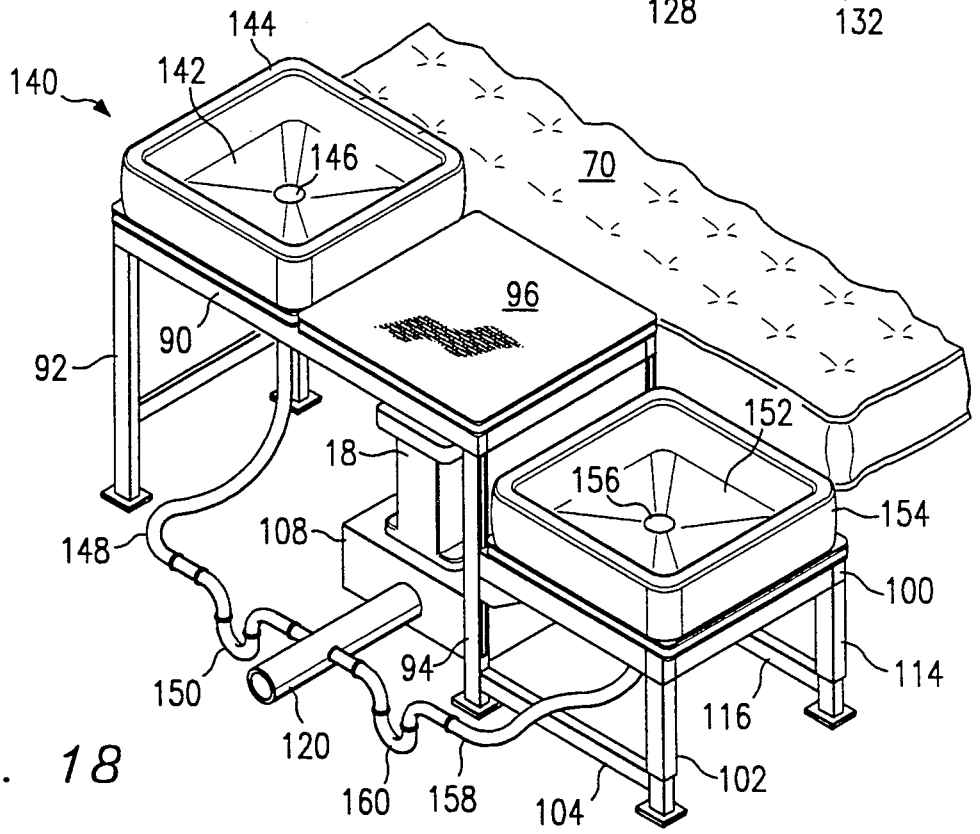
FIG. 18 illustrates a perspective view of the segmented commode section utilizing a smaller inflatable bath section that is operable to be utilized for washing hair, soaking, and the such.

Referring now to FIG. 18, there is illustrated an alternate embodiment of the present invention wherein a smaller bathing section 140 is placed on top of the end padded section 96. The bath section 140 is similar to the bath section 122 with the exception that it has dimensions similar to the pads 96 and 106, i.e. approximately two feet by two feet. The bath section 140 has a vinyl base layer 142 and a peripheral inflatable tube 144. The tube 144 is inflated with the pump 130, which is not shown. A drain hole 146 is disposed at the side of the bathing section 140 and connected through a drain tube 148 and a trap 150 to the sewer line 120. The bathing section 140 allows a patient's hair to be washed in a position adjacent to the bed. Additionally, the section in FIG. 18 is illustrated with a foot rest in the lower position to allow the patient to sit upright. Also a foot bath is provided that has a base layer 152 with an inflatable tube 154 disposed around the periphery thereof. A drain hole 156 is provided that is connected through a hose 158 and a trap 160 to the sewer line 120. This is similar to the bath section 140.

Figure 19:
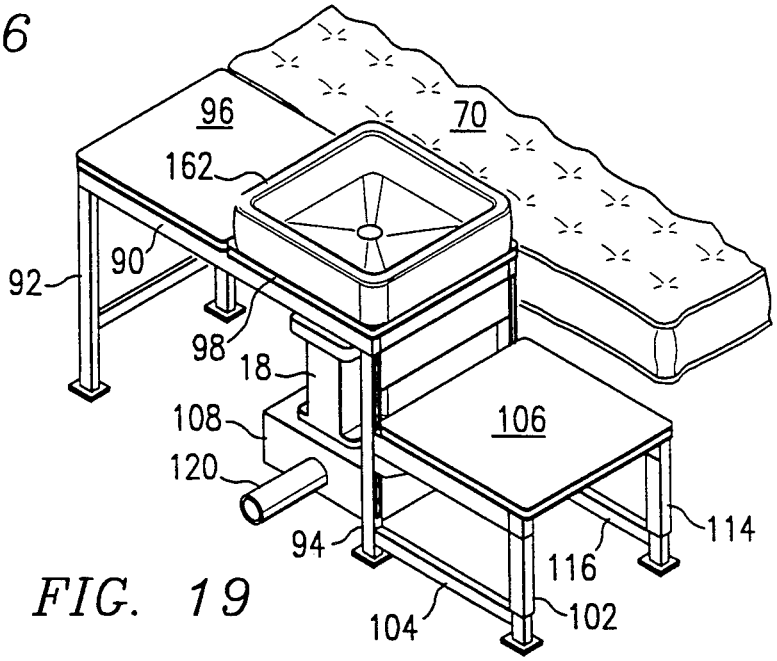
FIG. 19 illustrates an alternate embodiment in perspective view of the segmented commode utilizing the smaller inflatable bath section as a Sitz Bath.

Referring now to FIG. 19, there is illustrated an alternate embodiment of the present invention illustrating a bathing section 162 that is disposed on the center section 98. The bathing section 162 is similar to the bathing section 140 with the exception that the drain goes down through the center to the commode 18. The bathing section 162 is operable in the seated position with foot portion 106 being in the lowered position such that an individual can sit in the bathing section 162. This is typically utilized for "Sitz" baths.

In summary, there has been provided an integrated bed and commode with an inflatable bathing section. The bed is comprised of a primary sleeping surface and a secondary support surface that is disposed adjacent to the primary sleeping surface. The secondary support surface is provided with a hole therein and a commode disposed within the hole proximate thereto. Two sections are provided, one providing a support for the head and central section, and the foot section being an adjustable foot rest that can be used in a lower foot rest position, or a resting position such that the body can be disposed in a supine position. An inflatable section can be disposed on the secondary support section that has a lower surface of vinyl surrounded by an inflatable peripheral tube that, when inflated, can contain water in the central area thereto. A drain in the center allows water to escape. A water supply is provided for allowing water to be delivered to the patient's body for cleansing purposes.

Although the preferred embodiment has been described in detail, it should be understood that various changes, substitutions and alterations can be made therein without departing from the spirit and scope of the invention as defined by the appended claims.

What is claimed is:

1. A bed with an integrated commode and integrated bathing section, comprising:

a mattress and bed frame that comprise a primary sleeping surface, the primary sleeping surface being parallel with the floor on which said mattress and bed frame are disposed;

a flush commode having a commode bowl and a commode seat;

a secondary support surface and associated support, adjacent to and coplanar with said primary sleeping surface said secondary support surface having a hole disposed therethrough to communicate with said commode such that the upper surface of said commode seat is proximate to the same plane as the upper surface of said secondary support surface, the hole approximately the same size as the outer peripheral edge of said commode, said secondary support surface having first and second portions, said first portion comprising a central section having the hole disposed therein and a head section approximately the same size as the central section, said second portion comprising a foot section approximately the same size as the central section, said central, head and foot sections having a central pad, a head pad and a foot pad for being disposed thereon, said central section pad having a hole disposed therein for interfacing with said commode bowl;

said foot section being operable to be raised or lowered and fixed to either a lowered, horizontal foot rest position or a horizontal supine position coplanar with said first portion;

a bathing section positioned on said secondary support surface including:

a flat vinyl surface substantially the size of first and second portions, an inflatable tube disposed about the periphery of said flat vinyl surface and being integral therewith, said tube operable to contain water within the interior periphery edge thereof when inflated, said tube when inflated rising above the surface of said vinyl surface; and a drain disposed in the central portion thereof for interfacing with said commode.

2. The apparatus of claim 1 and further comprising means for adjusting the second portion of said secondary support surface between said supine position and said foot rest position.

3. The apparatus of claim 1 and further comprising a water supply for bathing the patient that is disposed in said bathing section.

4. The apparatus of claim 1 wherein said central pad, said head pad and said foot pad are removable.

* * * * *